US006644229B1

(12) United States Patent
Davenport

(10) Patent No.: US 6,644,229 B1
(45) Date of Patent: Nov. 11, 2003

(54) PONTOONS AND THE MANUFACTURE OF SAME

(75) Inventor: Wade E. Davenport, Crossville, TN (US)

(73) Assignee: Leisure Kraft Pontunes, Inc., Crossville, TN (US)

( * ) Notice: Subject to any disclaimer, the term of this patent is extended or adjusted under 35 U.S.C. 154(b) by 0 days.

(21) Appl. No.: 10/104,212

(22) Filed: Mar. 22, 2002

(51) Int. Cl.[7] ..... B63B 3/00
(52) U.S. Cl. ..... 114/61.1; 114/356
(58) Field of Search ..... 114/61.1, 356, 114/292, 283; 441/44, 45

(56) References Cited

U.S. PATENT DOCUMENTS 2,977,914 A * 4/1961 Gray et al. ..... 228/147
5,540,169 A 7/1996 Davis et al.
5,911,187 A 6/1999 Sohm
5,988,087 A 11/1999 Pepper
6,302,042 B1 * 10/2001 Biedenweg et al. ..... 114/61.22

* cited by examiner

*Primary Examiner*—Sherman Basinger
(74) *Attorney, Agent, or Firm*—Luedeka, Neely & Graham, P.C.

(57) ABSTRACT

A pontoon including a substantially cylindrical member having a length in excess of about 14 feet and having no external circumferential welds intermediate the ends of the member and being substantially linear along its length axis.

6 Claims, 16 Drawing Sheets

PONTOONS AND THE MANUFACTURE OF SAME

FIELD OF THE INVENTION

This invention relates generally to water craft. More particularly, this invention relates to pontoon flotation devices for water craft and to the manufacture thereof.

BACKGROUND AND SUMMARY OF THE INVENTION

Cylindrical aluminum pontoons generally have a main body made of a cylindrical member. Prior pontoons having a relatively long cylindrical member are constructed to have two or more cylindrical sections of aluminum welded together using circumferential welds intermediate the ends of the cylindrical section. The welds used to join the sections together are undesirable to performance and aesthetics of the pontoon.

The present invention is directed to a pontoon that uses a single section of aluminum to form the cylindrical section so as to avoid the need for circumferential welds intermediate the ends of the cylindrical section.

In a preferred embodiment, the pontoon includes a substantially cylindrical member having a length in excess of about 14 feet, no external circumferential welds intermediate the ends of the member, and being substantially linear along its length axis.

In another aspect, the invention relates to a pontoon boat having a pontoon and a deck buoyantly supported by the pontoon. The pontoon includes a substantially cylindrical member having a length in excess of about 14 feet, no external circumferential welds intermediate the ends of the member, and being substantially linear along its length axis.

In yet another aspect, the invention relates to apparatus for making a cylindrical member from a sheet material.

In a preferred embodiment, the apparatus includes a frame; first and second elongate rotatable rollers arranged and supported by the frame so that their length axis are substantially parallel in a vertical plane and spaced apart from one another in a horizontal plane, and a third elongate rotatable roller being arranged and supported by the frame so that the length axis of the third roller in the horizontal plane is between the length axis of the first and second rollers and the length axis of the third roller in the vertical plane is above the length axis of the first and second rollers. A drive system is operatively associated with each of the rollers for driving the rollers in a synchronized rotating motion. An anti-deflection system is operatively associated with the third roller and including a rigid member and roller contacting members connected to the rigid member for contacting desired portions of the third roller to urge the third roller so that it remains substantially axially linear when force is applied to it during manufacture of the cylindrical member.

In a still further aspect, the invention relates to a method for making a pontoon.

In a preferred embodiment, the method includes the steps of providing a sheet of aluminum having a length of at least 14 feet and encircling the sheet about its length axis using a roller having a length of at least 14 feet while simultaneously urging portions of the roller in a desired direction so that the roller is substantially axially linear.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

FIG. 3 is a close-up of a front or bow portion of the pontoon of FIG. 2.

FIGS. 12 and 13 show components of a drive system portion of the apparatus of FIG. 9.

DETAILED DESCRIPTION

Figure 1:
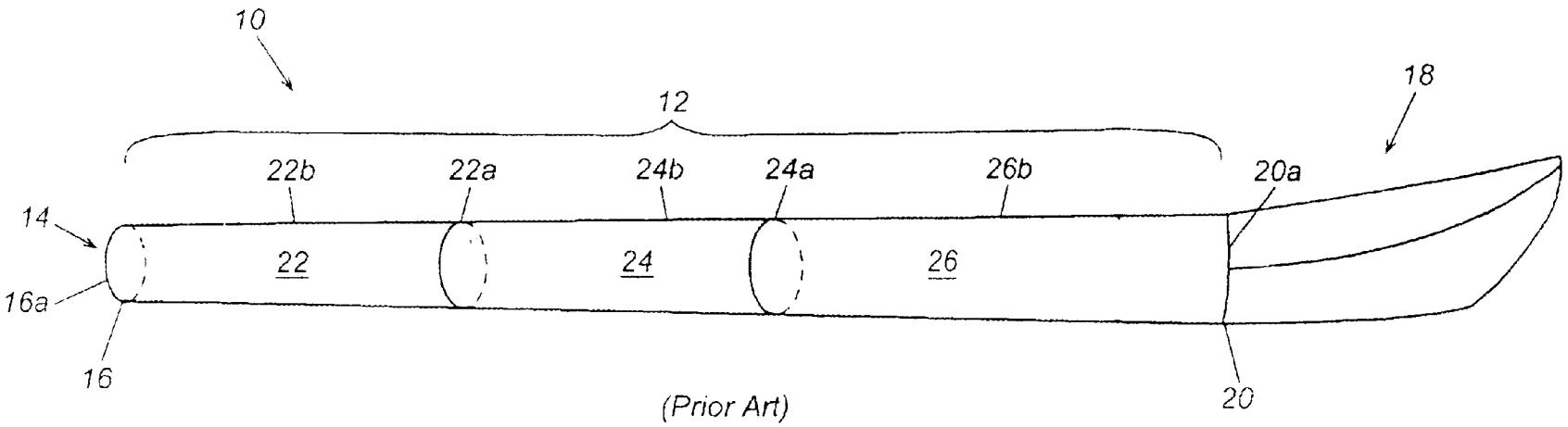
(Prior Art) Fig. 1
FIG. 1 is a perspective view of a prior art pontoon of the type having circumferential welds intermediate the ends of a cylindrical section of the pontoon.
Figure 2:
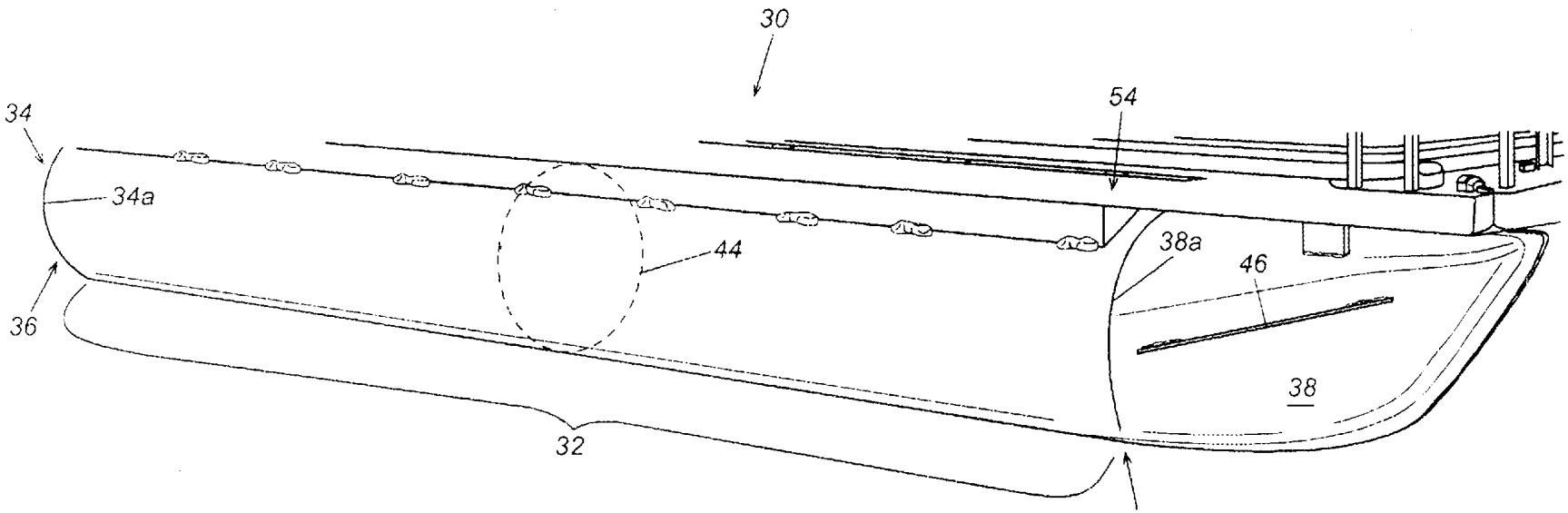
FIG. 2 is a perspective view of a pontoon in accordance with a preferred embodiment of the invention.

With initial reference to FIG. 1, there is shown a prior art aluminum pontoon 10 of the type having a cylindrical central member 12 in excess of about 12 feet. A cap plate 14 is located at rear end 16 of the member 12 and a conical bow section 18 is located at front end 20 of the member 12. The central member 12 is made of a plurality of aluminum cylindrical sections 22, 24, and 26. The sections 22–26 are arranged end-to-end and welded together using circumferential exterior welds **22*a* and 24*a* intermediate the ends 16 and 20 of the cylindrical member 12. The cap plate 14 is welded to the end 16 of the member as by circumferential exterior weld 16*a* and the bow section 18 is attached to the section 26 as by circumferential exterior weld 20*a*. Each section 22–26 has a length of about 12 feet or less and is provided by a sheet of aluminum material shaped in a desired substantially cylindrical configuration and attached to itself, such as by longitudinal welds 22*b*, 24*b*, and 26*b***.

The use of a plurality of cylindrical sections welded end-to-end to provide the cylindrical member 12 is disadvantageous. For example, it is difficult to align and weld the sections 22–26 to yield a member 12 that is substantially straight. Also, the intermediate welds 22*a* and 22*a* have undesirable drag characteristics. However, until the present invention, it has not been possible to provide a cylindrical member having suitable linearity, a length in excess of about 14 feet, and formed using a single sheet of aluminum.

The invention advantageously provides aluminum pontoons having a central section in excess of about 14 feet and made of a single sheet of aluminum. In the context of the prior art pontoon 10 of FIG. 1, the invention advantageously avoids the use of multiple sections, such as the three sections 22–26, and the associated circumferential welds, such as the welds 22*a* and 24*a* located between the ends 16 and 20 and used to join the sections 22, 24, and 26.

Figure 4:
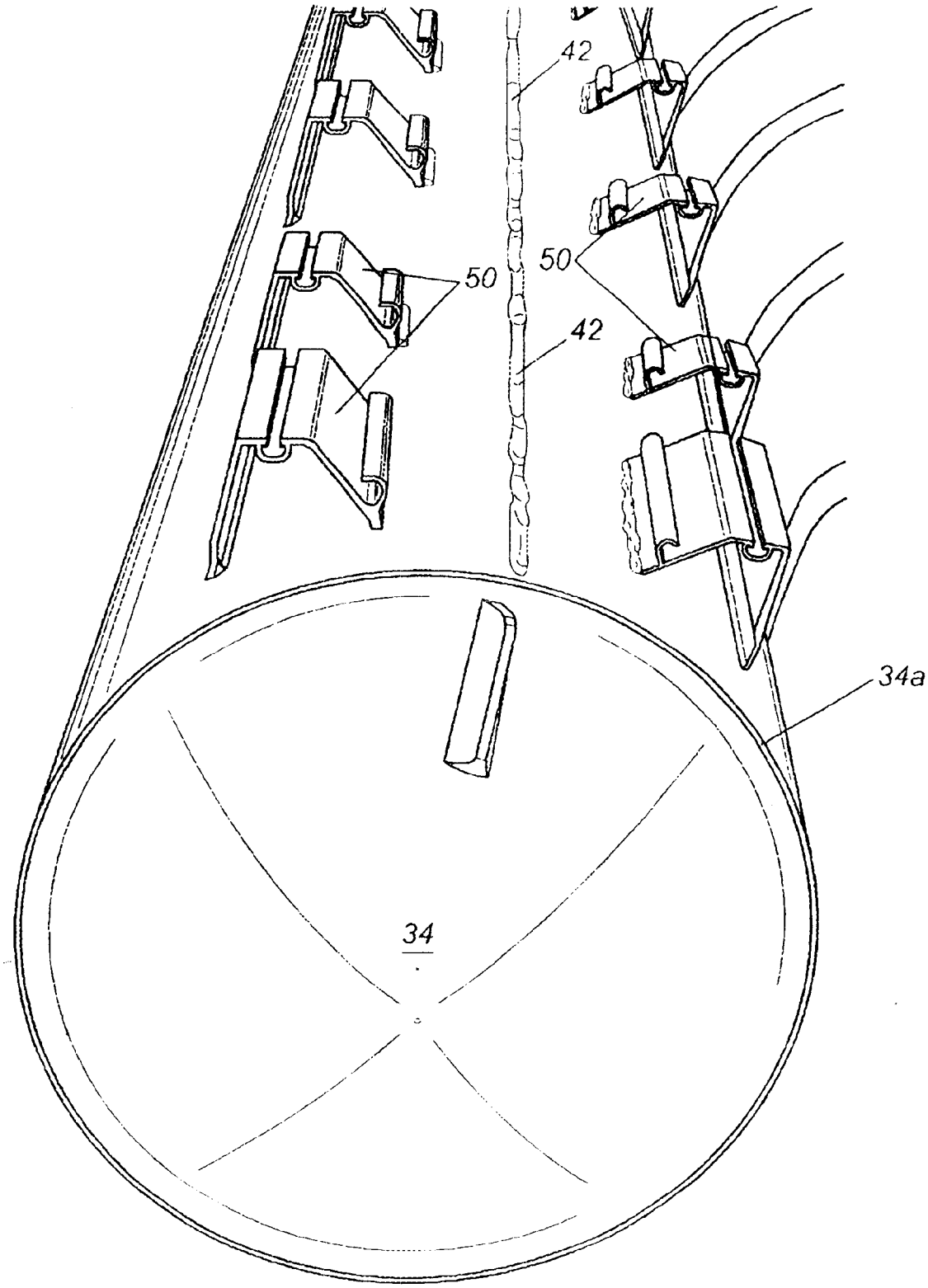
FIG. 4 is a close-up view of the rear end cap of the pontoon of FIG. 2.
Figure 5:
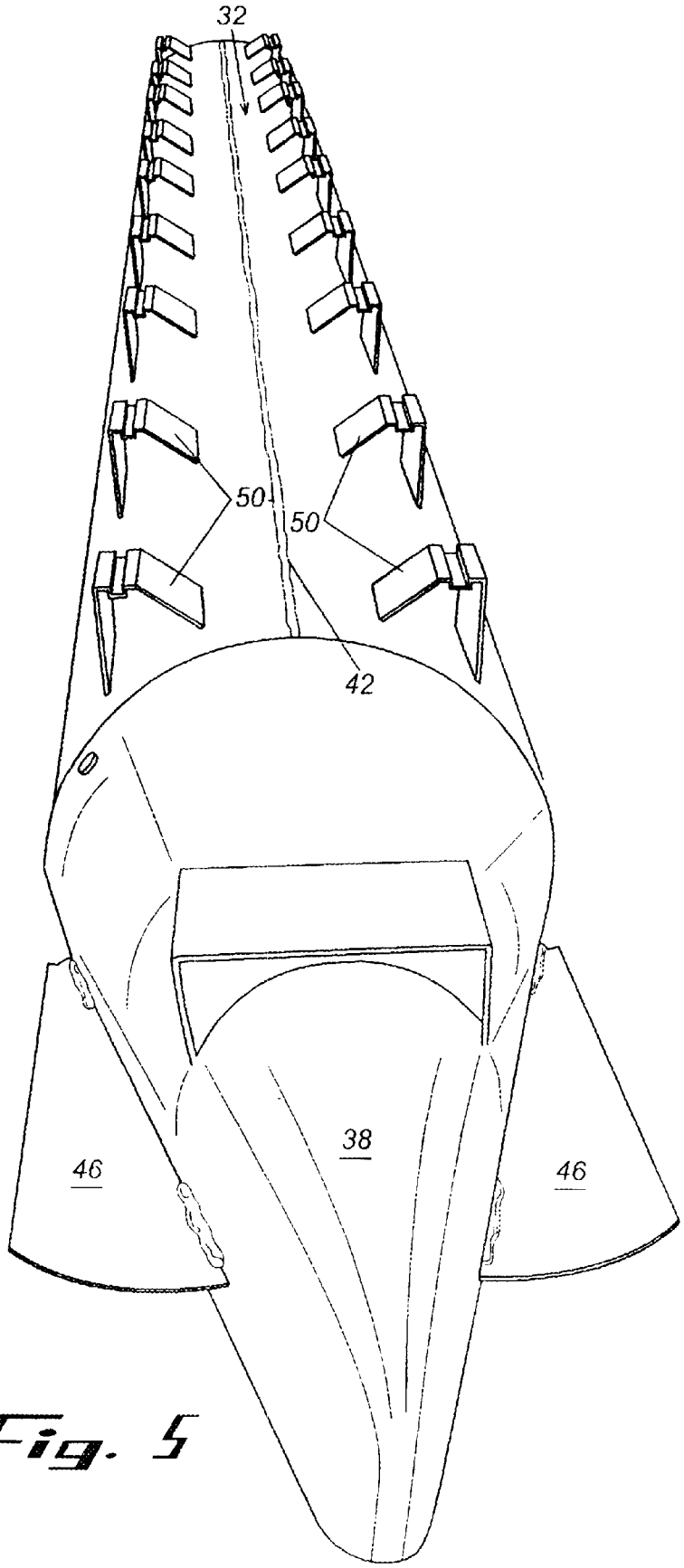
FIG. 5 is a perspective view of the pontoon of FIG. 2.
Figure 6:
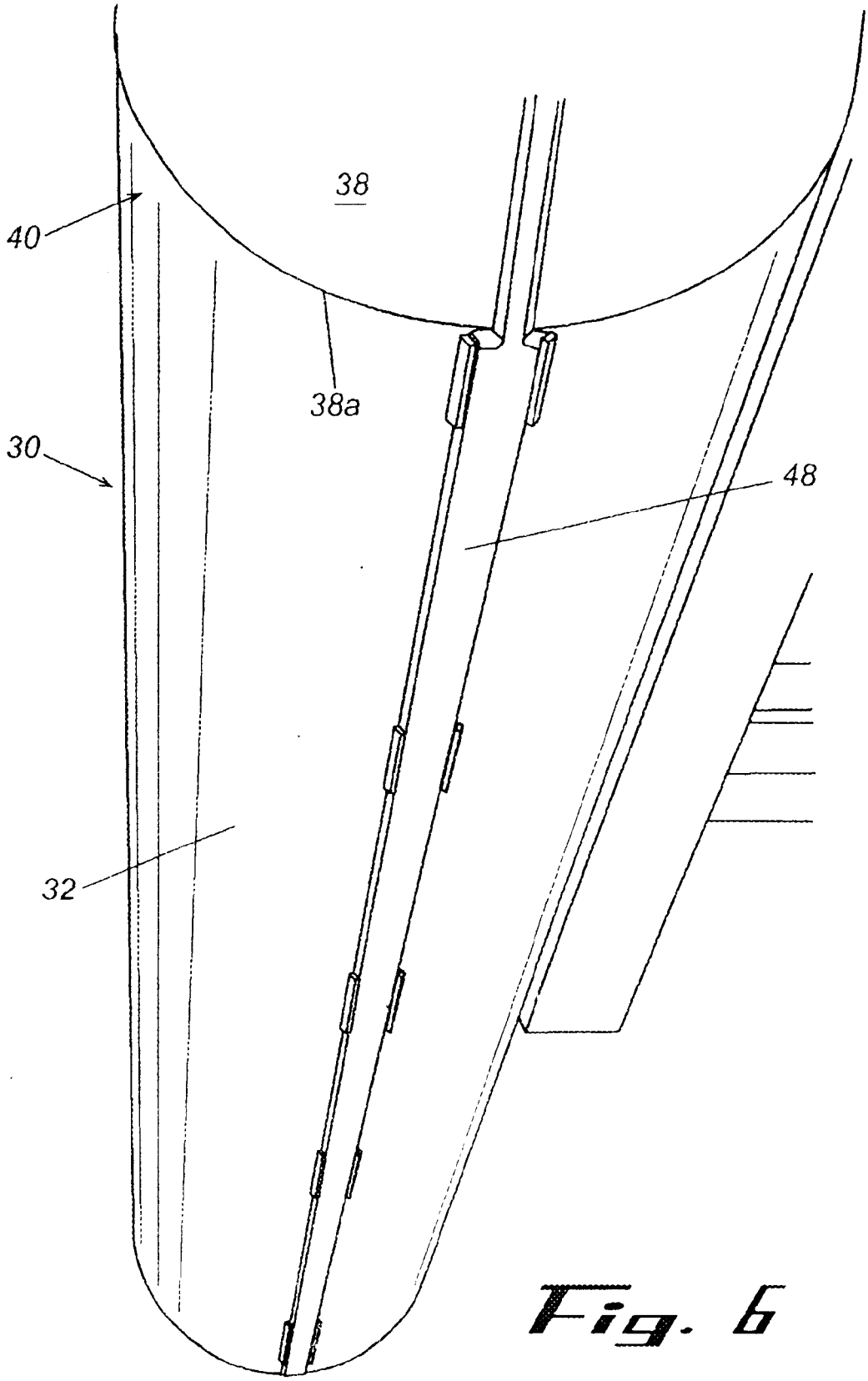
FIG. 6 is a bottom perspective view of the pontoon of FIG. 2.
Figure 7:
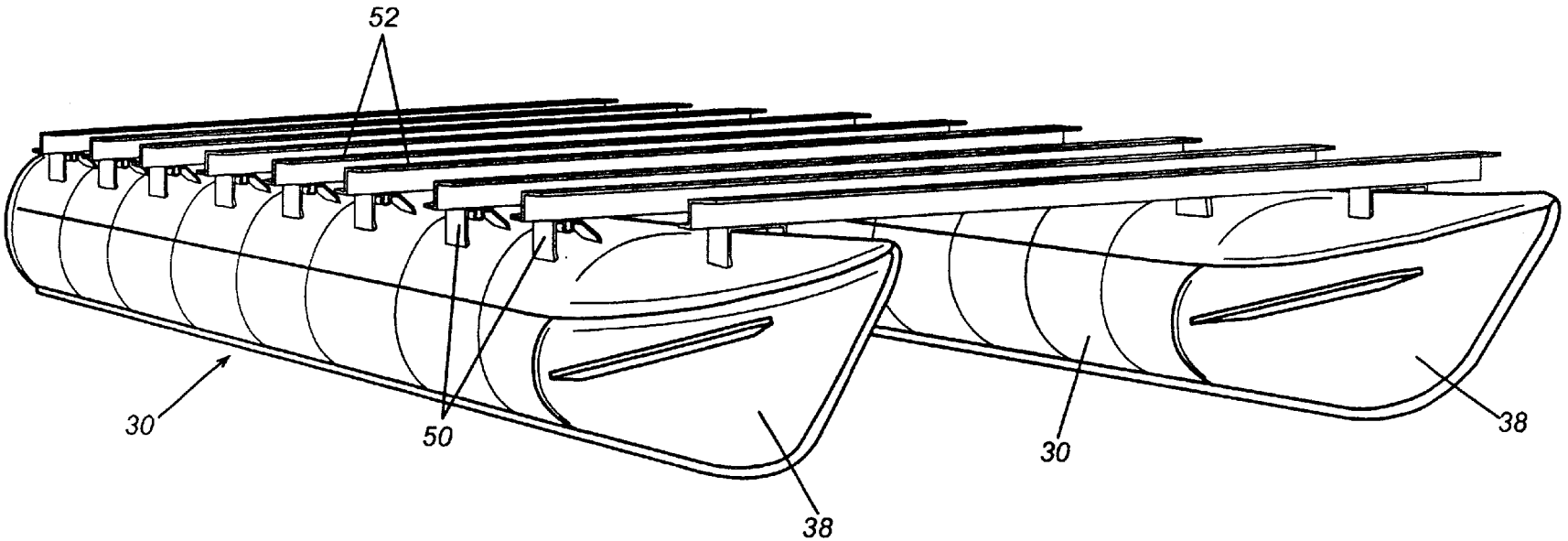

With reference to FIGS. 2–6, the invention relates to a pontoon 30 having a single cylindrical central section 32 having a length in excess of about 14 feet. A cap plate 34 is located at rear end 36 of the section 32 and attached thereto as by circumferential weld 34*a* at the rear end 36. A conical bow section 38 is located at front end 40 of the section 32 and attached thereto as by circumferential weld 38*a* at the front end 40. The central section 32 has no external circumferential welds intermediate the ends 36 and 40 thereof and the only external weld located between the ends 36 and 40 is a single longitudinal exterior weld 42 (FIG. 4).

The interior of the section 32 may preferably include one or more baffles 44 to segregate the interior of the section 32 into two or more separate compartments to help the pontoon remain buoyant if punctured. Each baffle 44 is preferably a circular plate of aluminum secured within the central section as by an interior circumferential weld or adhesive.

Figure 7:
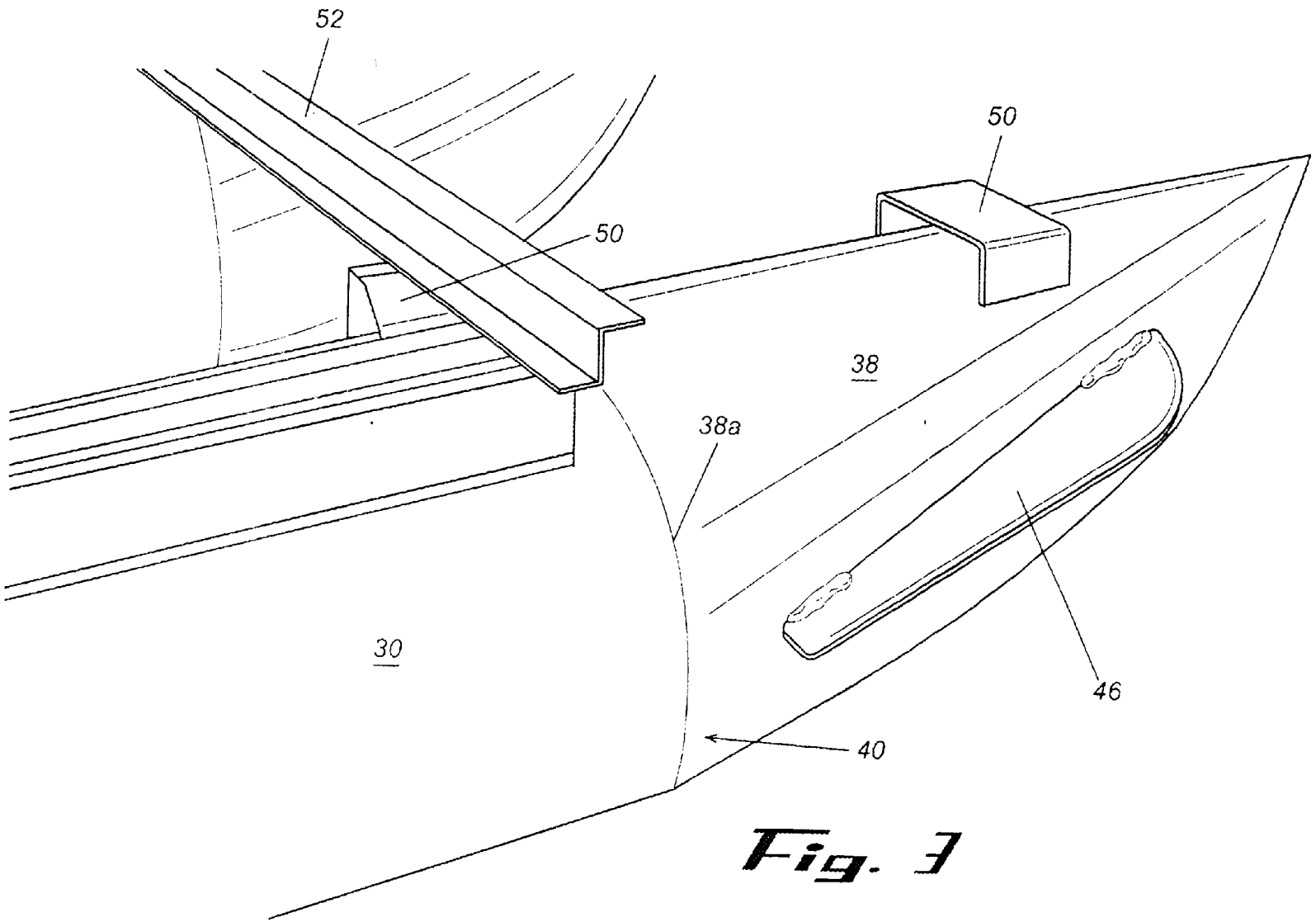
FIG. 7 is a front perspective view showing a pair of the pontoons of FIG. 2 oriented and having cross bars attached thereto in the manufacture of a boat using the pontoons.
Figure 8:
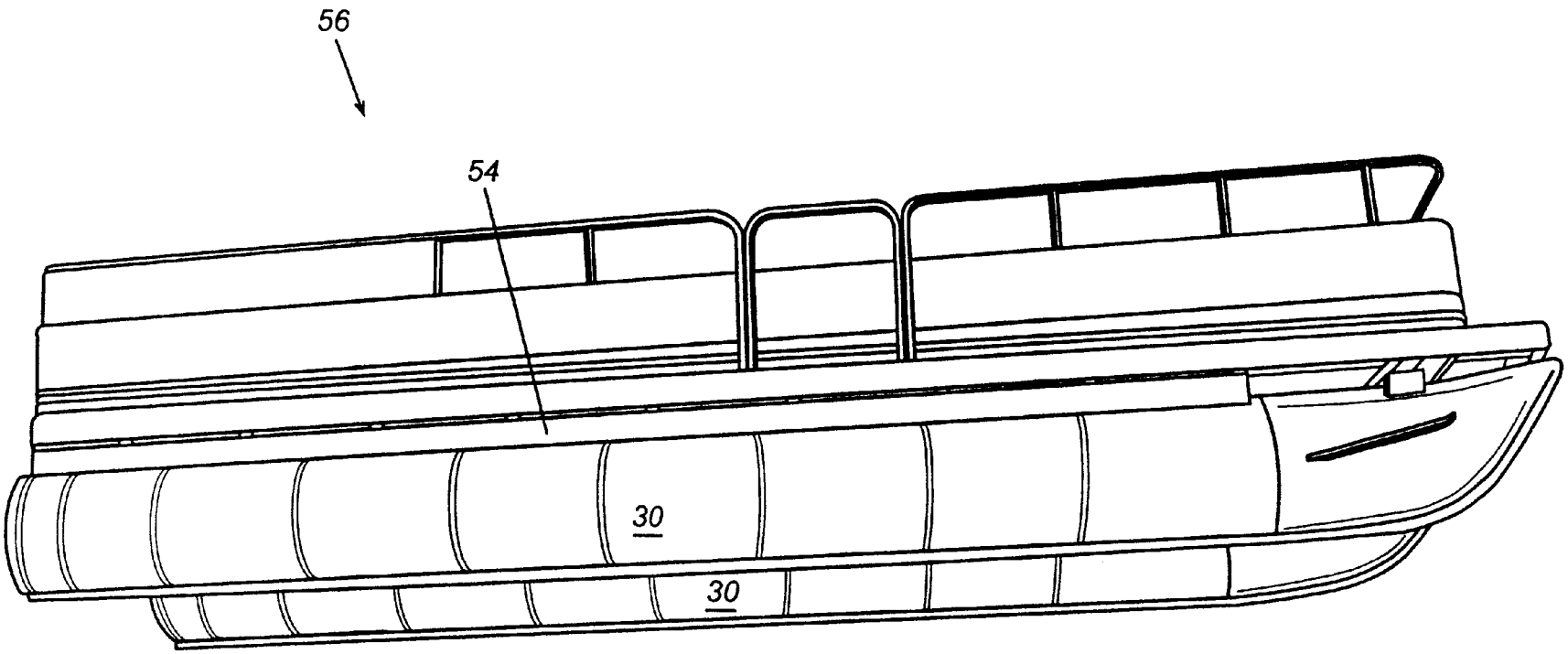
FIG. 8 is a side view showing a boat made using the pontoon of FIG. 2.
Figure 9:
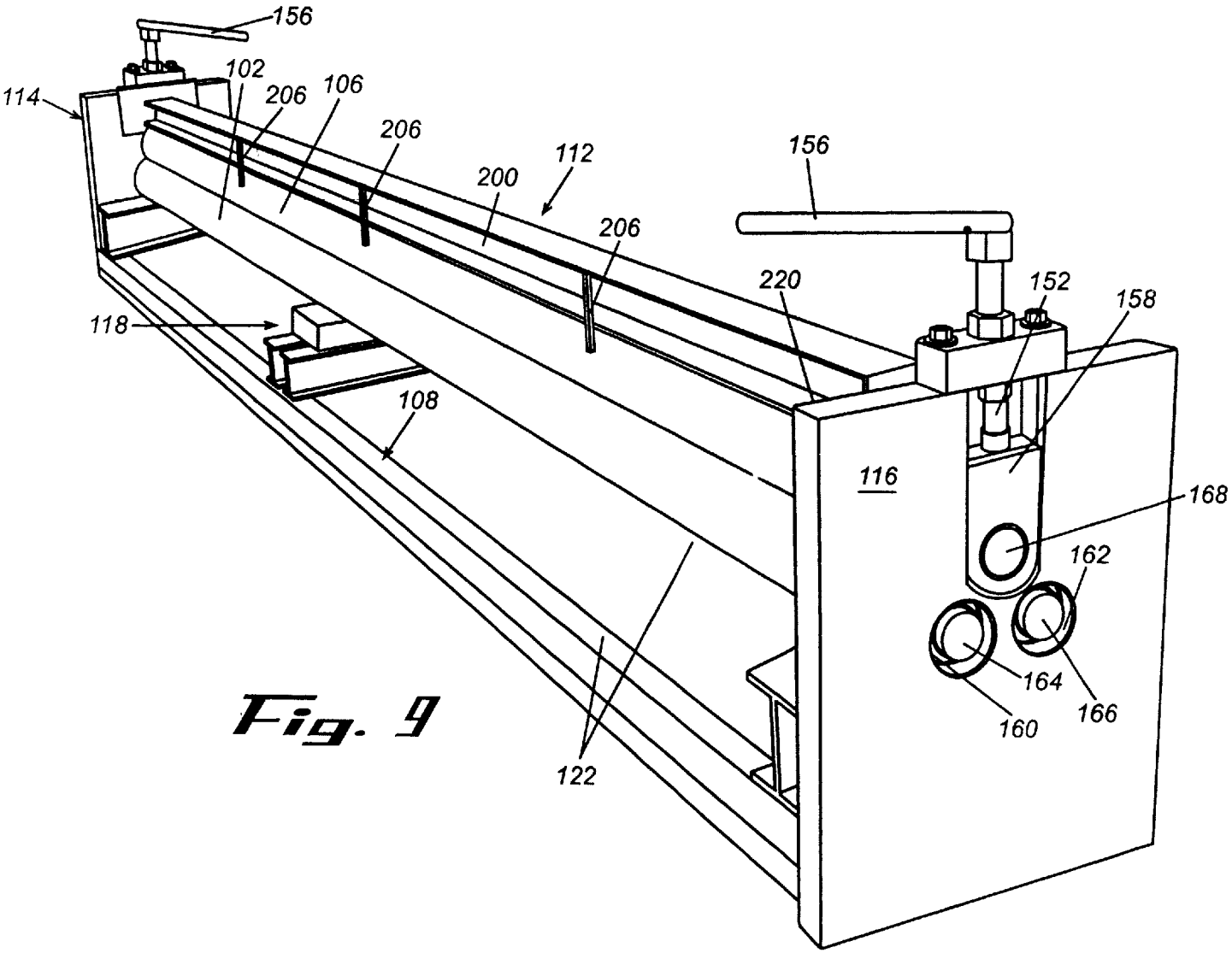
FIG. 9 is a font perspective view of apparatus in accordance with the invention for use in manufacture of the pontoon of FIG. 2.

With reference to FIGS. 4–7, the pontoon 30 also preferably includes one or more splash fins 46, a keel 48, and a plurality of deck uprights 50. The fins, keel, and uprights are also preferably of aluminum construction and attached as by welding to the exterior of the pontoon 30. With reference to FIG. 7, a pair of the pontoons 30 may be secured in a desired orientation as by welding cross bars 52 between adjacent ones of the deck uprights 50. A deck 54, preferably of marine grade plywood, may be secured to the crossbars 52, as by bolts or other fasteners, to yield a boat, such as pontoon boat 56 shown in FIG. 8.

Figure 20:
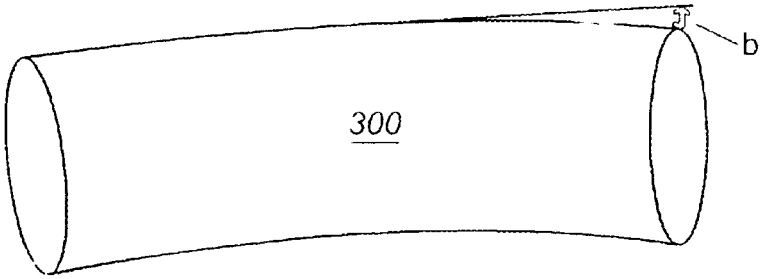
FIG. 20 shows an example of a cylinder that is not substantially linear along its length.

The section 32 of the pontoon 30 preferably has a length in excess of about 14 feet and, most preferably from about 20 to about 25 feet (or longer) with an internal diameter of from about 20 to about 28 inches. For the purpose of example, a pontoon 30 having a cylindrical section 32 with a length of 25 feet and an interior diameter of 25 inches is preferably formed using a sheet S of aluminum (FIG. 11) having a length of about 21 feet, a width of about 6 ½ feet, and a thickness of about 1/12 inch. The section 32 has a desirable geometry in that is of one-piece construction, does not include any circumferential welds between the ends 36 and 40, and is substantially straight and not bowed or curved along its length. That is, the section 32 is substantially linear along its length axis. As explained in more detail in connection with FIG. 20, a cylinder is not considered to be substantially linear if it exhibits a bow, curvature or other deviation in excess of about ½ inch. Preferably, the section 32 achieved has a deviation of less than about ⅛ inch.

Turning now to FIGS. 9–15, there are shown aspects of an apparatus 100 useful for manufacture of the cylindrical section 32 of the pontoon 30. The apparatus 100 includes three elongate rollers 102, 104, and 106. The rollers 102–106 are rollably mounted onto a frame assembly 108 and coupled to a drive system 110. The apparatus also includes an anti-deflection system 112. For manufacture of pontoons having the dimensions described previously, each roller 102–106 is preferably a solid steel shaft having a length of 25 feet and a diameter of 8 inches, and which has been turned, ground, and polished so as to have a substantially smooth and uniform exterior surface.

The frame assembly 108 is preferably of steel construction and includes a pair of end supports 114 and 116 and cross-members 122 extending between lower ends of the supports 114 and 116.

A lower roller support system 118 cooperates with the frame 108 for supporting the rollers 102 and 104 and inhibiting downward deflection of the rollers 102 and 104 when the rollers are placed under a load as during forming of the sheet S into the cylindrical section 32. As explained more fully below, the anti-deflection system 112 functions to inhibit deflection of the roller 106. Thus, the lower roller support system 118 and the anti-deflection system 112 cooperate to inhibit deflection of the rollers 102–106 to inhibit undesirable deflection or bending of the rollers. Deflection of the rollers is undesirable and renders a cylindrical section that is not substantially linear along its length axis.

Figure 11:
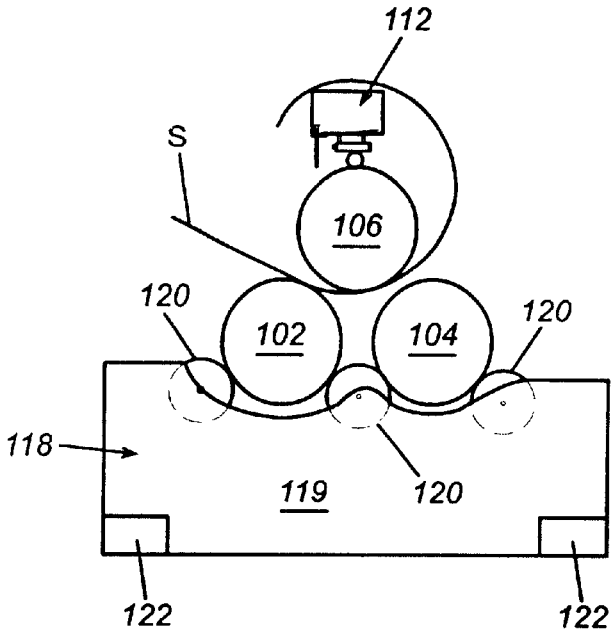
FIG. 11 is a cross-sectional end view taken along line 11—11 of FIG. 9.

With reference to FIG. 11, the lower roller support system 118 is preferably mounted onto the cross members 122 and includes a support member 119 having a plurality of wheels 120 rollably mounted thereto as by shafts and bearings connected to the member 119. The member 119 is preferably a steel member having a contoured upper surface for positioning the wheels 120 underneath and in contact with the rollers 102 and 104, preferably adjacent the longitudinal midpoints of the rollers 102 and 104 is a single system 118 is used. Alternatively, two or more support systems 118 may be used and positioned to support the rollers 102 and 104 at desired portions thereof to inhibit downward deflection of the rollers 102 and 104, particularly adjacent their longitudinal midpoints. The wheels 120 preferably include bearings and are made of a substantially hard surface to inhibit marring or other damage to the surface of the rollers. For example, the wheels 120 may be of hardened steel construction with a chrome plating.

The end support 114 is preferably made of steel plates and includes apertures 124 and 126 for mounting bearings 128 and 130 associated with the ends of rollers 102 and 104 adjacent the end support 114. The end support 114 includes a vertically adjustable member 132 configured to retain a bearing 134 associated with the end of the roller 106 adjacent the support 114. Sprockets 136, 138, and 140 are preferably secured to the bearings 128, 130, and 134 adjacent surface 142 of the end support 114. As described in more detail below, the sprockets 136–140 cooperate with the drive system 110 for rotating the rollers.

The vertically adjustable member 132 is located within a preferably rectangular aperture 144 extending through the thickness of the support 114. In a preferred embodiment, the vertically adjustable member 132 is provided as by a steel block 146 having an internal aperture 148 configured for receiving the bearing 134. An upper end 150 of the block 146 is connected to a threaded shaft 152 threadably received as by bolts 154 welded to portions of the support 114. Rotation of the shaft 152 as by lever 156 enables the block 146 to be incrementally adjusted in the vertical plane to permit vertical adjustment of the end of the shaft 106.

The end support 116 is substantially identical to the end support 114 and includes a vertically adjustable member 158 that is substantially identical to the to permit the opposite end of the shaft 106 to be similarly vertically positioned. The end support 116 further includes apertures 160 and 162 for mounting bearings 164 and 166 associated with the ends of rollers 102 and 104 adjacent the support 116. The vertically adjustable member 158 is configured to retain a bearing 168 associated with the end of the roller 106 adjacent the support 116.

Figure 10:
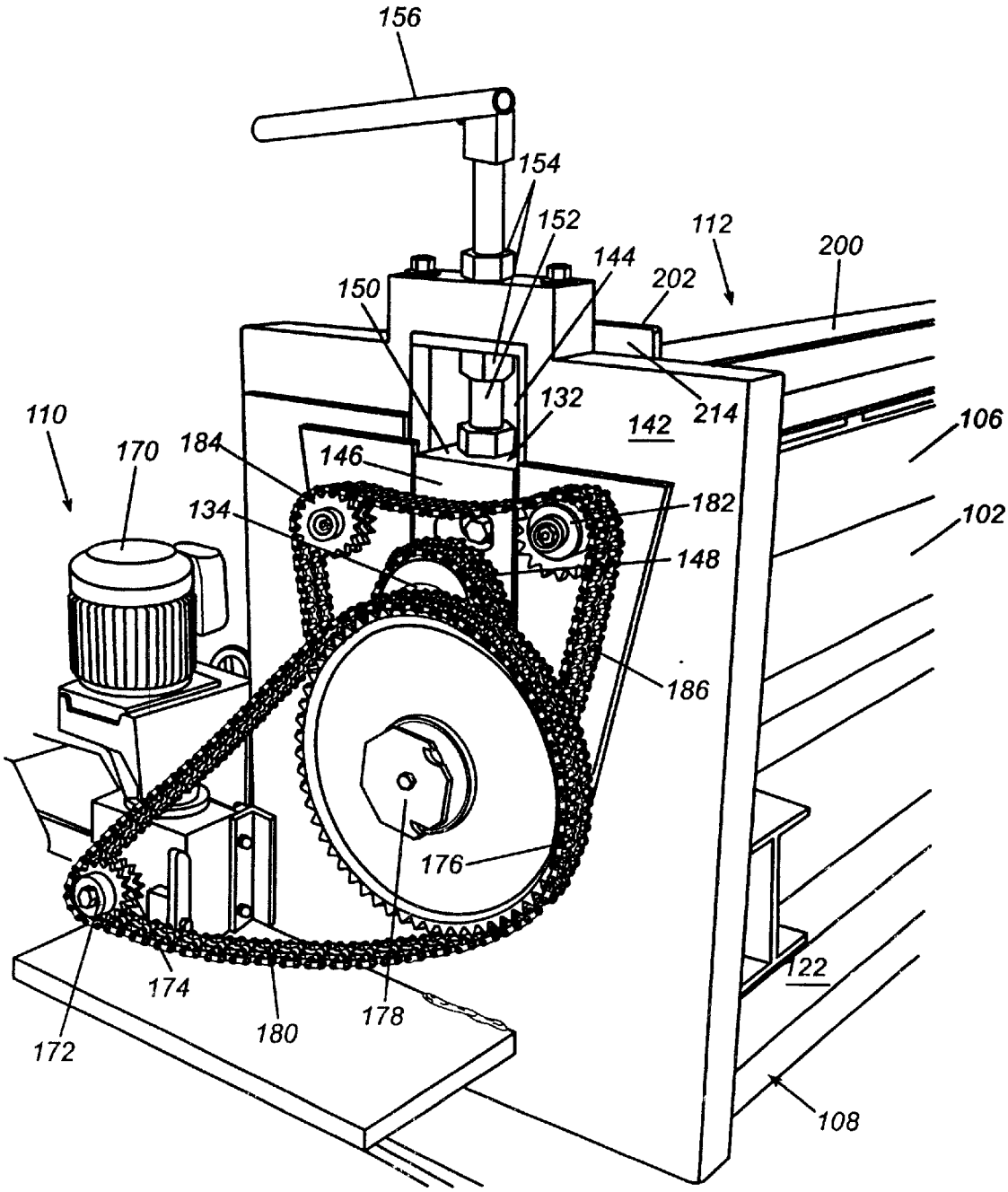
FIG. 10 is an end view of the apparatus of FIG. 9.
Figure 12:
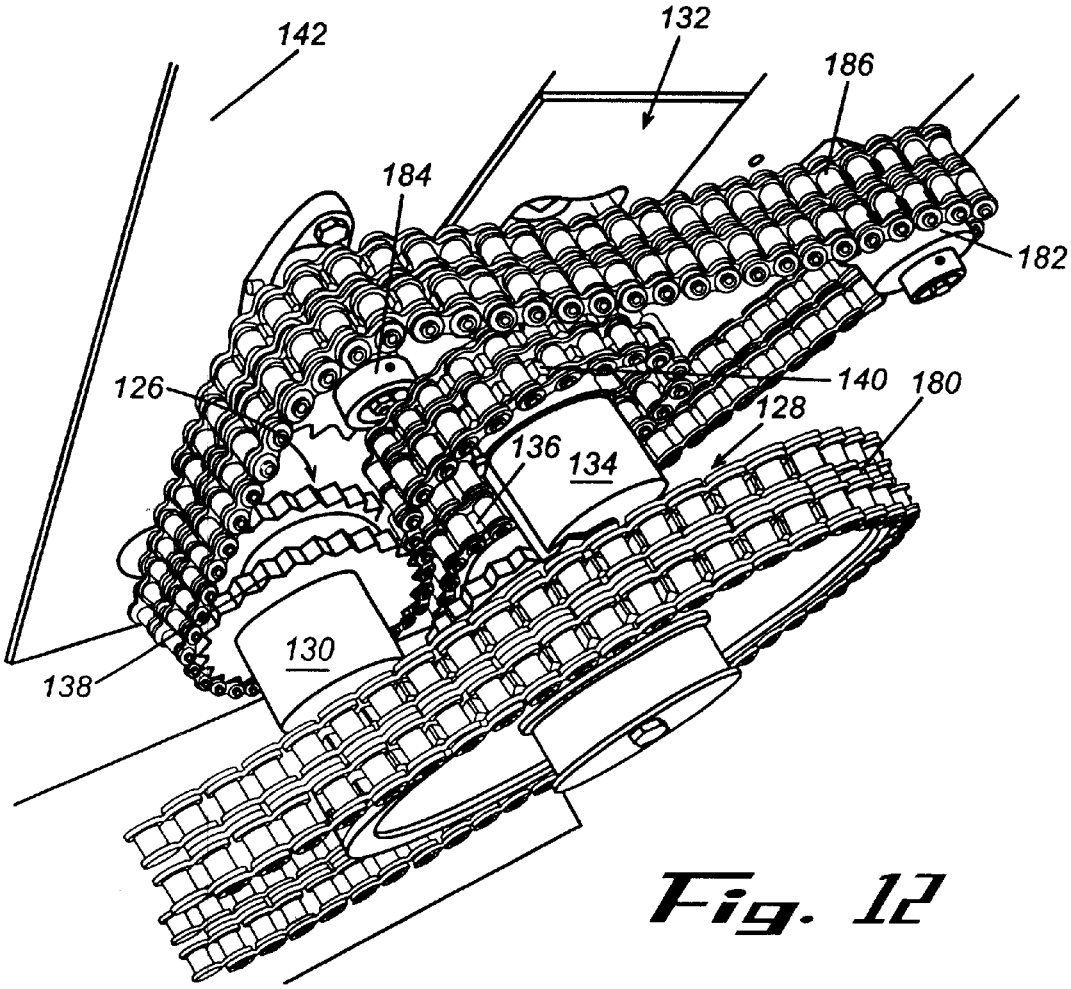

With reference to FIGS. 10, 12 and 13, the drive system 110 includes a variable speed motor 170 having an output shaft 172 fitted with a drive gear 174, a main gear 176 fitted on a shaft 178 extending outwardly from and directly connected to the end of the bearing 128 associated with the roller 102, a main chain 180 engaging the drive gear 174 and the main gear 176, a pair of idler gears 182 and 184 for facilitating adjustment of chain slack, and a secondary chain 186 engaging the sprockets 136, 138, and 140, and the idler gears 182 and 184. The chains, gears and rollers rotate or otherwise move in directions corresponding to the arrows A of FIG. 13. As will be appreciated, the roller 102 is directly driven by the main gear 176 and the other rollers 104 and 106 are correspondingly driven via the described assembly. In this regard, it is noted that it is preferable that each of the sprockets 136–140 pull so that a substantially constant load is applied to each of the rollers 102–106 and each roller rotates at the same speed.

With reference to FIGS. 9 and 14–17, the anti-deflection system 112 includes an elongate rigid member 200, a pair of mounting plates 202 and 204 at opposite ends of the member 200, a plurality of shields 206, and a roller contact system 208.

The rigid member 200 is preferably a steel I-beam having a length corresponding substantially to the length of the rollers 102–106. A preferred I-beam for use with the described rollers is a steel I-beam having a width of about 6 inches.

Figure 17:
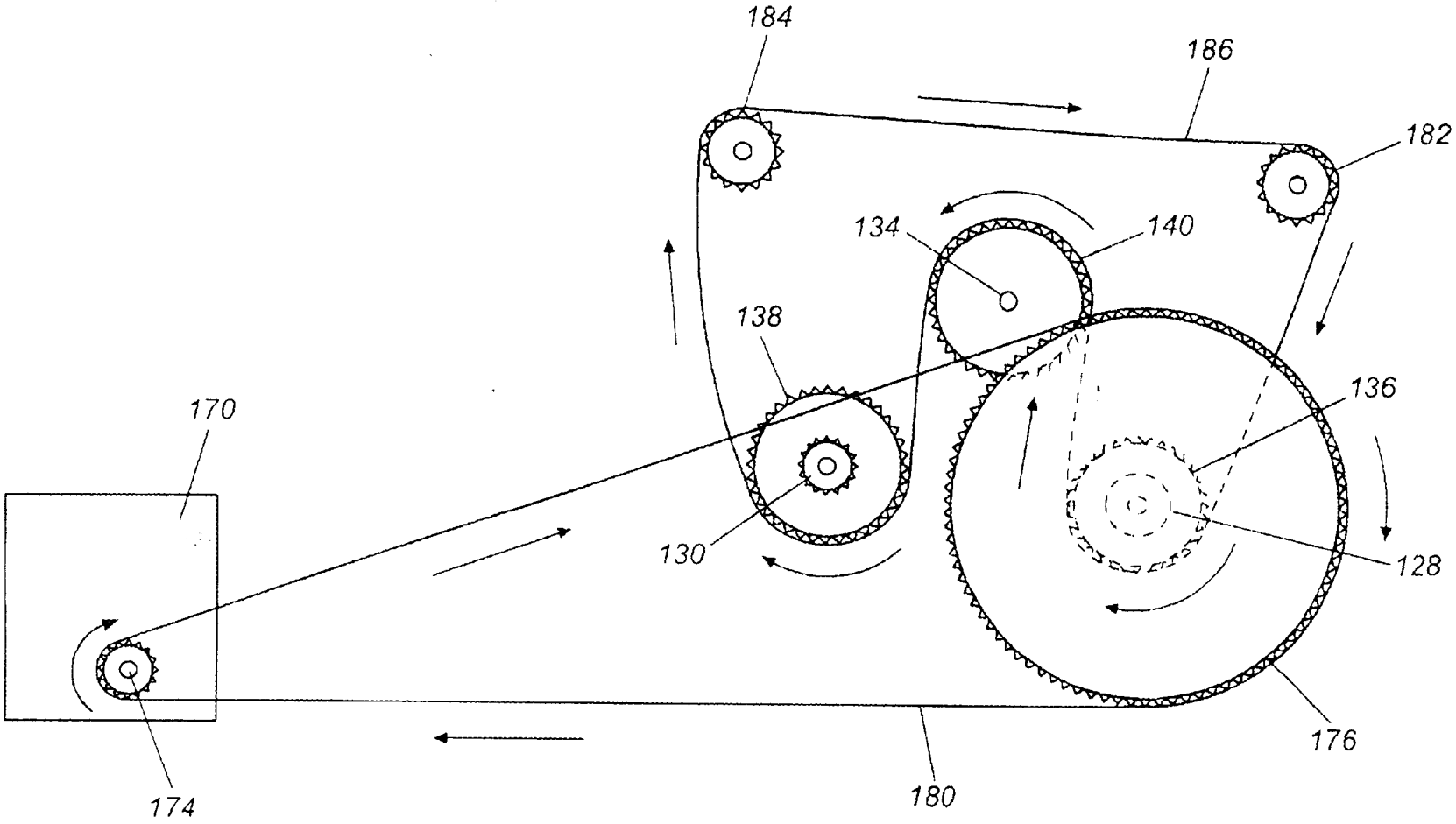
FIG. 17 is an exploded view of the end portion of FIG. 16.
Figure 14:
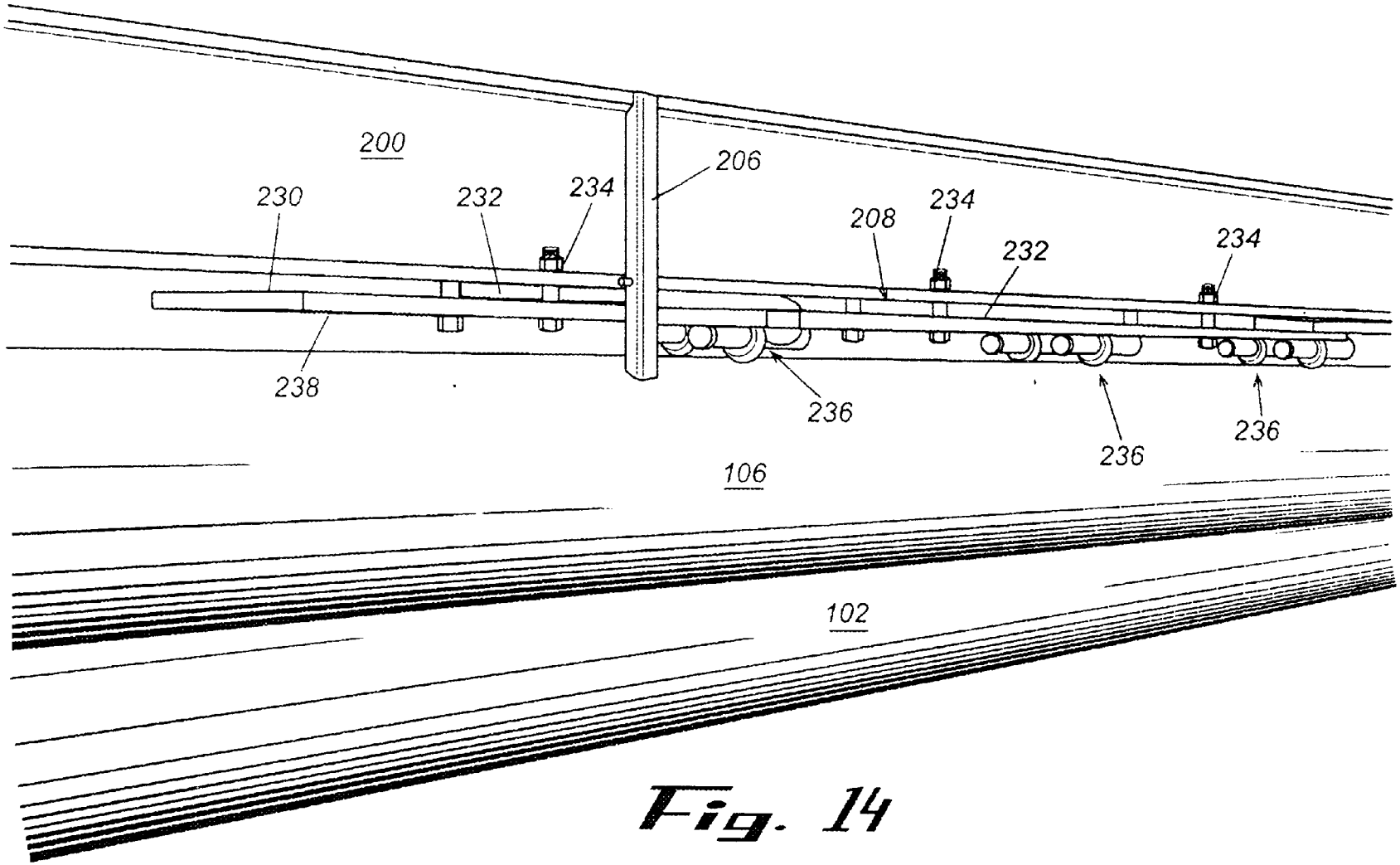
FIGS. 14 and 15 are close-up views of portions of the apparatus of FIG. 9.
Figure 15:
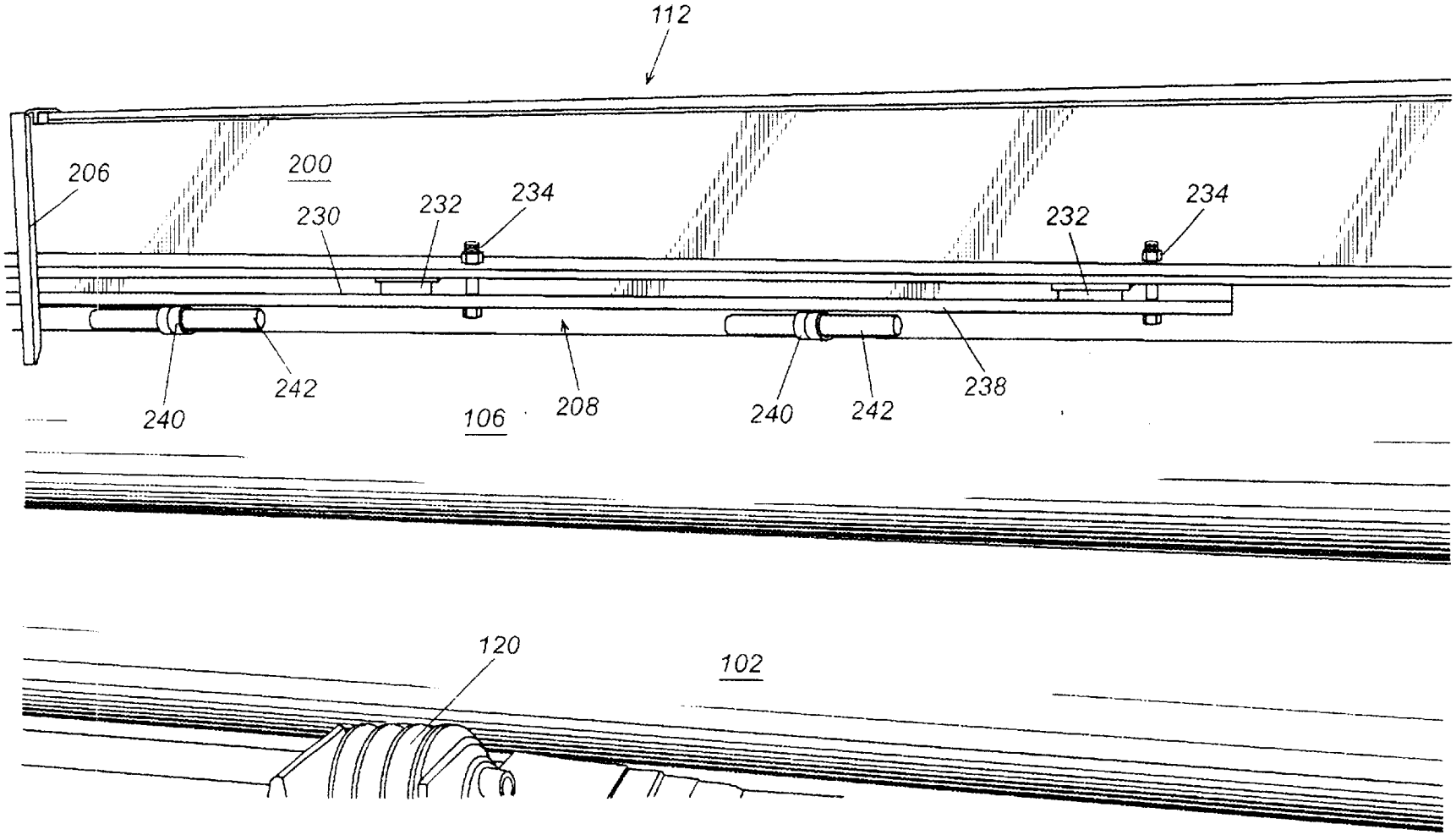
Figure 16:
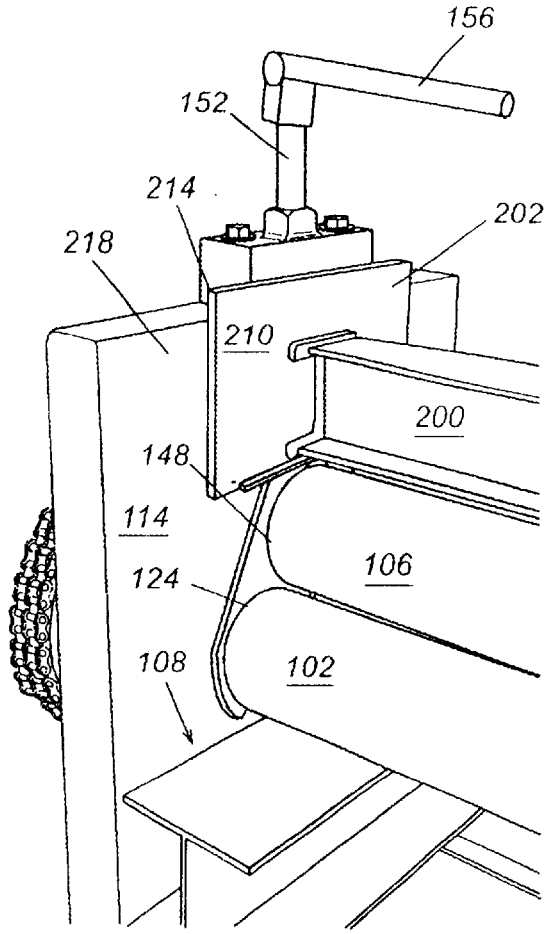
FIG. 16 is a close-up view of an end portion of the apparatus of FIG. 9.
Figure 17:
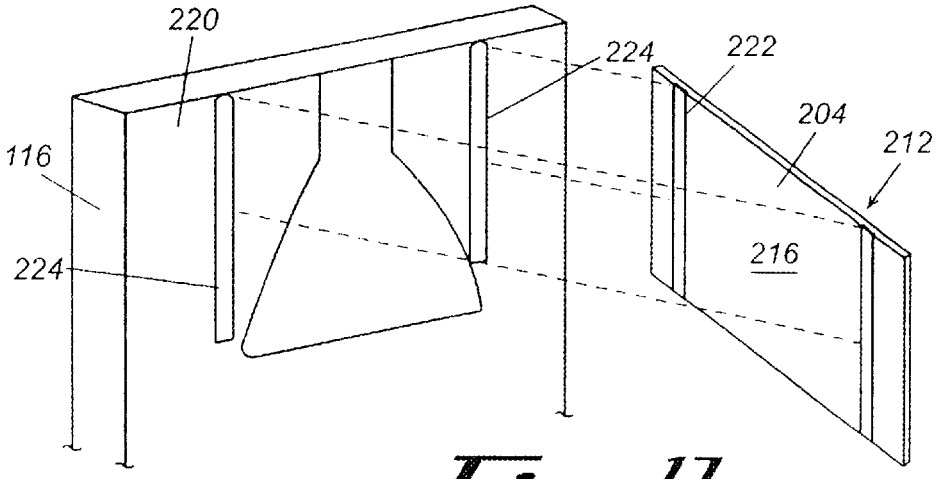

Each of the mounting plates 202 and 204 is preferably a steel plate welded to one of the ends of the rigid member 200 so that the plane of inner face surfaces 210 and 212 of the plates 202 and 204, respectively, are parallel to one another and perpendicular to the length of the rigid member 200. Opposite outer face surfaces 214 and 216 of the plates 202 and 204 face and abut surfaces 218 and 220 of the end supports 114 and 116, respectively. The outer face surfaces 214 and 216 preferably include guide grooves 222 formed thereon for receiving corresponding guides 224 located on the surfaces 218 and 220 of the end supports 114 and 116 (FIG. 17).

The grooves 22 and the guides 224 cooperate to maintain the position of the rigid member 200 in a desired orientation in the x and z planes relative to the roller 106. Preferably, the rigid member 200 is maintained such that its longitudinal center line is aligned with the longitudinal centerline of the roller 106. The position of the rigid member 200 relative to roller 106 in the vertical or y axis is preferably constant, with the spacing between the rigid member 200 and the top of the roller 106 preferably being from about 1 to about 3 inches when working with the aluminum sheets described previously. Accordingly, to maintain the desired relationship between the member 200 and the roller 106, portions of the outer face surfaces 214 and 216 of the plates 202 and 204 are preferably connected to the vertically adjustable members 132 and 158 of the end supports 114 and 116. For example, portions of the outer face surfaces 214 and 216 may be welded to a facing portion of the block 146 of each vertically adjustable member 132 and 158. Thus, rotation of the shaft 152 of each member 132 and 158 as by its lever 156 during vertical adjustment of the ends of the shaft 106 simultaneously adjusts the vertical position of the rigid member, while maintaining the relative positions of the rigid member 200 and the roller 106.

The shields 206 are preferably portions of steel bars that are welded or otherwise secured to the rigid member 200 and extend downwardly toward the roller 106. The shields 206 divert formed portions of the aluminum sheet from contacting the roller 106.

Returning to FIGS. 14 and 15, the roller contact system 208 preferably includes an elongate bar 230 generally aligned with the common center-line member 200 and the roller 106, spacers 232 between the bar 230 and the rigid member 200, fasteners 234 for securing the bar 230 adjacent the rigid member 200, and roller contact members 236 extending from bottom surface 238 of the bar 230 for contacting the upper surface of the roller 106.

For the apparatus 100 configured for working with the described aluminum sheets to yield cylindrical sections 32 having a length of about 25 feet and a diameter of about 25 inches, the bar 230 is preferably a rigid steel bar having a thickness of from about ½ to about 1 ½ inch and a length of from about 10 to about 20 feet, most preferably about 14 feet with the longitudinal midpoint of the bar 230 substantially corresponding to the longitudinal midpoint of the roller 106. The fasteners 234 are preferably threaded nuts and bolts passed through corresponding and aligned apertures located on the rigid member 200 and the bar 230. As will be appreciated, the use of the threaded nuts and bolts facilitates adjustment of the relative vertical position between the bar 230 and the member 200 (and hence the relative position of the roller contact members and the roller 106).

The roller contact members 236 are preferably provided as by wheels 240 rotatingly mounted on shafts 242 secured to the bottom surface 238 of the bar 230 as by welds or other suitable mounts. The wheels 240 preferably include bearings and are made of a substantially hard surface to inhibit marring or other damage to the surface of the roller 106. For example, the wheels 240 may be of hardened steel construction with a chrome plating. It is desired that the relative position of the roller contact members 236 and the roller 106 be adjusted such that the roller contact members 236 urge against the roller 106 when the roller 106 is under load during forming of a sheet of aluminum into a cylinder and thereby urge the roller 106 toward a linear orientation.

Figure 18:
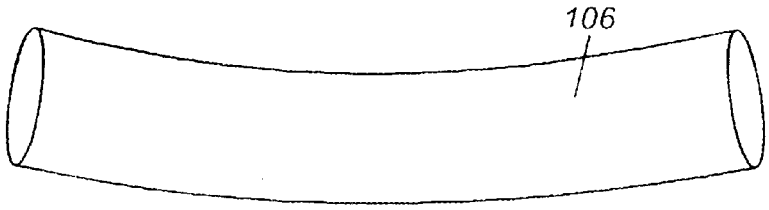
FIG. 18 shows a roller sagging downwardly at rest.
Figure 19:
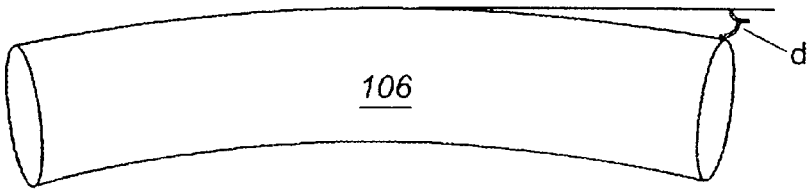
FIG. 19 shows a roller bending upwardly when placed under a load.

For the purpose of a comparative example, with reference to FIG. 18, there is shown the roller 106 prior to application of a load thereto. As will be appreciated, the roller tends to sag along its length. FIG. 19 shows the same roller 106 during application of a load thereto as would be experienced by the roller during forming of a sheet of aluminum. As will be appreciated, the roller tends to bend upwardly along its length. This bending or curvature of the roller becomes excessive for rollers having a length in excess of about 14 feet and the curvature or bending of the roller is imparted to the formed aluminum, thus rendering formed aluminum that is unsuitable for use as a pontoon in that the resulting cylinder would bow or curve and would not be substantially linear along its length axis. For the purpose of comparative example, there is shown the roller 106 having a length of about 25 feet and in use to form the described aluminum sheet, but without use of the anti-deflection system 112. Under such conditions, the roller will generally have a bow or curvature, as represented by distance d in FIG. 19, in excess of about 1 inch. Such a roller curvature generally results in a cylinder 300 (FIG. 20) having a length of about 25 feet and a corresponding bow or curvature b in excess of about 1 inch, such that the cylinder 300 is not substantially linear along its length axis.

As mentioned previously, the lower roller support system 118 inhibits deflection of the lower rollers 102 and 104, such deflection generally being a downward deflection away from the roller 106. Absent the lower support system 118, the rollers 102 and 104 will each have a bow or curvature of at least about 1 inch when under load. Thus, absent the lower roller support system 118 and the anti-deflection system 112, the rollers 102–106 would each deflect at least about 1 inch and result in a cylinder having a deflection in excess of about 1 inch and generally at least about 3 inches.

The apparatus of the invention thus enables curvature or bending of the rollers to be substantially eliminated when the rollers are under load, thereby permitting cylinders having lengths of about 14 feet or greater to be made from a single sheet of aluminum, with the resulting cylinders being substantially linear along their length axis.

Figure 21:
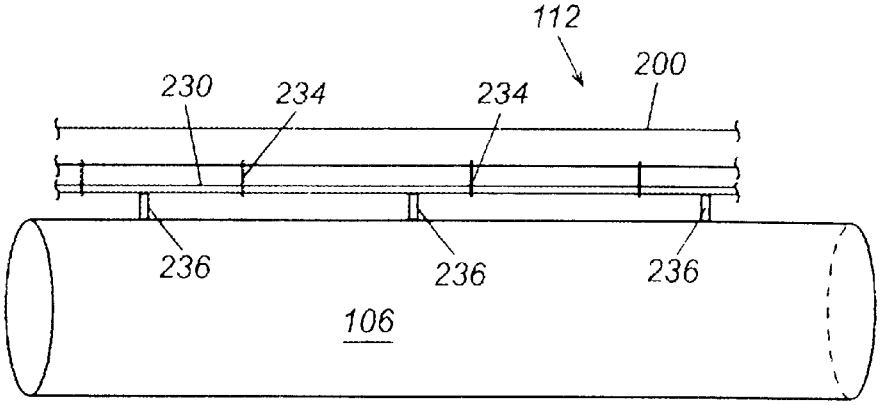
FIG. 21 shows maintenance of a roller in a substantially linear orientation when placed under a load and in accordance with a preferred embodiment of the invention.

For example, with reference to FIG. 21, there is seen the roller 106 under load during the formation of a cylinder from a sheet of aluminum. As will be appreciated, the anti-deflection system 112 urges the roller 106 to a substantially linear orientation. The lower roller support system 118 likewise urges the rollers 102 and 104 to a substantially linear orientation. This advantageously enables manufacture of cylinders with a substantially linear length axis.

The lower roller support system is preferably of fixed orientation to maintains the rollers 102 and 104 so that they remain substantially linear at all times. To configure the anti-deflection system 112 to appropriately influence the linearity of the roller 106, the fasteners 234 are adjusted so that the roller contact members 236 are spaced away from the roller 106 and the roller 106 is placed under a load as by feeding a sheet of aluminum through the rollers 102–106. The motor is then stopped with the roller 106 maintaining a bowed configuration such as seen in FIG. 19. The fasteners are then adjusted to urge the roller contact members 236 against the roller as necessary to urge the roller 106 to a substantially linear orientation. A surveying transit is preferably used to obtain information concerning the linearity of the roller 106 or the amount of non-linearity so that appropriate adjustment of the fasteners may be made. In this regard it is noted that the adjustment generally varies along the length of the roller, since those portions of the roller most proximate the longitudinal midpoint of the roller will tend to have a greater amount of bowing and require more correction.

After the apparatus 100 is configured as by adjustment of the anti-deflection system 112, one of the sheets S is passed through the rollers (FIG. 11) to form the sheet S into a generally cylindrical form. The side edges of the thus formed sheet are clamped in an abutting relationship and the weld 42 applied to yield the central section 32. The baffles 44 are installed, and then the cap 14 and the conical section 18. Finally, the splash fins, deck uprights and other features may be attached.

The invention advantageously reduces the time and steps involved in making a pontoon. For example, the invention enables a cylindrical section having a length of about 14 feet or more, made from one piece of aluminum, and having a substantially liner profile. Another advantage is the elimination of external circumferential welds between the ends of the cylindrical section. Eliminating these circumferential welds eliminates significant time and labor associated with the manufacture of the cylindrical section, and hence the overall pontoon. Also, as the circumferential welds are unattractive and provide drag to the pontoon, eliminating the welds offers improvements in aesthetics and performance.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A pontoon, comprising a substantially cylindrical member having a length in excess of about 14 feet and including first and second opposite ends, wherein the cylindrical member has no external circumferential welds intermediate the first and second ends and is substantially linear along its length axis and does not exhibit a bow, curvature or other deviation in excess of about ½ inch, and wherein the cylindrical member is made from a single sheet of aluminum having a thickness and encircled about itself so as to have an internal diameter of at least about 20 inches, a ratio of diameter to wall thickness in excess of about 200, and secured together by a single longitudinal weld.

2. The pontoon of claim 1, wherein the cylindrical member has a length of at least about 20 feet.

3. The pontoon of claim 1, further comprising a cap adjacent the first end of the cylindrical member and a bow section adjacent the second end of the cylindrical member.

4. A pontoon boat, comprising a pontoon and a deck buoyantly supported by the pontoon, wherein the pontoon includes a substantially cylindrical member having a length in excess of about 14 feet and including first and second opposite ends, wherein the cylindrical member has no external circumferential welds intermediate the first and second ends and is substantially linear along its length axis and does not exhibit a bow, curvature or other deviation in excess of about ½ inch, and wherein the cylindrical member is made from a single sheet of aluminum having a thickness and encircled about itself so as to have an internal diameter of at least about 20 inches, a ratio of diameter to wall thickness in excess of about 200, and secured together by a single longitudinal weld.

5. The pontoon boat of claim 4, wherein the cylindrical member has a length of at least about 20 feet.

6. The pontoon boat of claim 4, wherein the pontoon further includes a cap adjacent the first end of the cylindrical member and a bow section adjacent the second end of the cylindrical member.

* * * * *